United States Patent [19]

Granite

[11] 4,015,782

[45] Apr. 5, 1977

[54] DEVICE FOR REDUCING POLYMERS OR THE LIKE TO SUBSTANTIALLY UNIFORM SMALL SIZE PIECES

[76] Inventor: Bernard H. Granite, 3519 Rhode Island Ave. South, St. Louis Park, Minn. 55426

[22] Filed: July 9, 1975

[21] Appl. No.: 594,455

[52] U.S. Cl. ..... 241/62; 241/190; 241/222; 241/243; 241/DIG. 31

[51] Int. Cl.[2] ..... B02C 13/26

[58] Field of Search ..... 241/62, 190, 222, 243, 241/285 B, 28, DIG. 31; 83/675

[56] References Cited

UNITED STATES PATENTS

| | | | |
|---|---|---|---|
| 2,832,546 | 4/1958 | Sprague | 241/62 X |
| 2,970,780 | 2/1961 | Bowen | 241/243 X |
| 3,151,814 | 10/1964 | Morgan et al. | 241/190 X |
| 3,360,204 | 12/1967 | Merges et al. | 241/285 B X |
| 3,545,686 | 12/1970 | Brown | 241/243 X |
| 3,690,358 | 9/1972 | Tilby | 241/62 |
| 3,721,392 | 3/1973 | Burwell | 241/280 X |
| 3,762,256 | 10/1973 | Frantz | 241/243 X |
| 3,837,586 | 9/1974 | Perschbacher et al. | 241/222 UX |

*Primary Examiner*—Roy Lake
*Assistant Examiner*—Howard N. Goldberg
*Attorney, Agent, or Firm*—Dugger, Johnson & Westman

[57] ABSTRACT

A machine for chopping polymers, and in particularly elastomeric materials such as tires, into uniform small size particles through the use of a rotating cutting head having teeth that have side cutting edges generally perpendicular to their outer end edges, which are parallel to the axis of rotation, and interfit with stationary teeth formed in complimentary shape. The cutting head is used in combination with a material infeed mechanism that maintains a steady, positive feed of material to reduce the elastomeric material into uniform small chunks that can be used for fuel, or otherwise more readily disposed than the present large size tires or similar articles.

15 Claims, 5 Drawing Figures

DEVICE FOR REDUCING POLYMERS OR THE LIKE TO SUBSTANTIALLY UNIFORM SMALL SIZE PIECES

BACKGROUND OF THE INVENTION

1. Field of the Invention

The present invention relates to devices for reducing material into uniform small size pieces.

2. Prior Art

The problems in shredding polymers, elastomers, and similar materials are well known. One of the items that is the most difficult to dispose of still comprises the automobile tire which is a tough elastomeric material. Many land fill operations will not take tires, and while the elastomer forming the tire is valuable as a fuel, a full size tire cannot be burned in most furnaces. Shredding a tire is an extremely difficult proposition because of the resiliency, toughness, and general resistance to any type of cutting action of the ordinary vehicle tire.

Prior art devices for chopping polymers, and shredding other materials have been advanced. A type of knife used on a rotor, cooperating with a bed knife for chopping material such as plastic is shown in U.S. Pat. No. 3,779,123. A sawtooth type design is incorporated, and with such sawtooth design, in a uniform infeed, strips of material are removed, rather than small uniform pieces which find utilization in automatic feeders for furnaces or the like. A similar device is shown in U.S. Pat. No. 3,545,686, and another sawtooth design which is specifically utilized in a two step cut is shown in U.S. Pat. No. 3,762,256. Again the sawtooth edges shown in these mentioned patents will result in a strip being removed from the material to be shredded or chopped up, and will not accomplish the results of producing a uniform size piece of material that is of small enough size so that it can be used in furnaces or the like for generating power.

Other rotating devices that are used for chopping materials are shown in U.S. Pat. No. 3,658,256, which shows knives which work against a sawtooth bed, and U.S. Pat. No. 3,602,445 which is used for propelling material against a impact surface for shredding.

SUMMARY OF THE INVENTION

The present invention relates to a device for chopping or reducing materials, such as polymers or elastomers into uniform size pieces that can be used for fuel in many types of furnaces, and which are capable of being automatically fed. When not used as a fuel, the small pieces are more easily disposed of than large pieces of the material, and are more suitable for reclaiming the material or for other processing, either chemical or mechanical.

The device incorporates a square tooth shape on the knives of a rotor acting against complimentary shaped stationary knives on the bed of an infeed mechanism. Power feed rolls may be provided for compressing and holding, as well as positively driving the material to be shredded into the rotor so that at a uniform rate of feed, uniform size chunks will be removed, and these chunks will be discontinuous, that is discrete or separated, so that the chunks or pieces can be fed with automatic feeders if used for fuel.

The tooth shape comprises a rectangular shape, which would look something similar to a square wave, that intermeshes with the complimentary tooth. The edges of the teeth are such that they will be substantially perpendicular to the leading end of the tooth which is generally parallel to the axis of rotation of the rotor. The side edges are thus perpendicular to the axis of rotation also. The side edges of the teeth cut straight lines to insure that the pieces will be severed into individual uniform size pieces.

The rotor construction includes means for easily mounting and removing the teeth, and is made so that the teeth can be sharpened in place on the machine. Also, the bed knife can be sharpened in place merely by putting a carrier for a grinder on the bed above the knives and moving the grinder along its supports while the teeth are ground.

The details of the infeed device can be varied to suit existing circumstances, but in the general situation where tires are to be reduced into uniform size pieces, the beads comprising the metal strands around the inner edge of the tire are first removed, and then the tire is merely placed on a bed, compressed by infeed rolls and fed at a uniform rate into the cutting knives. The rotor includes flywheels for providing sufficient inertia to complete a cut.

BRIEF DESCRIPTION OF THE DRAWINGS

FIG. 1 is a part schematic side vertical sectional view of a device made according to the present invention;

DESCRIPTION OF THE PREFERRED EMBODIMENT

Figure 2:
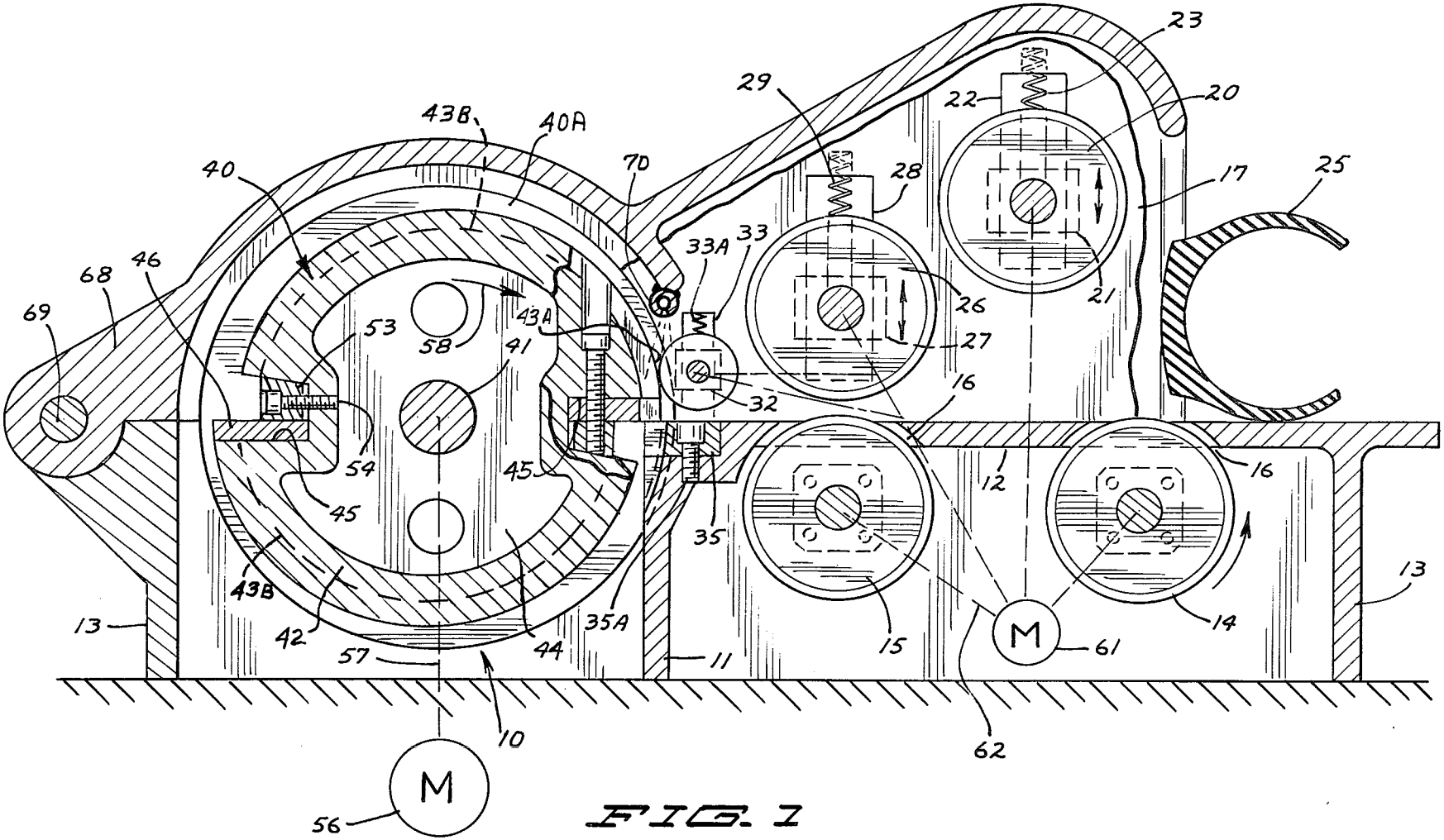
FIG. 2 is a perspective illustration of the rotor and bed knife of the device of FIG. 1 with parts in section and parts broken away.
Figure 2:
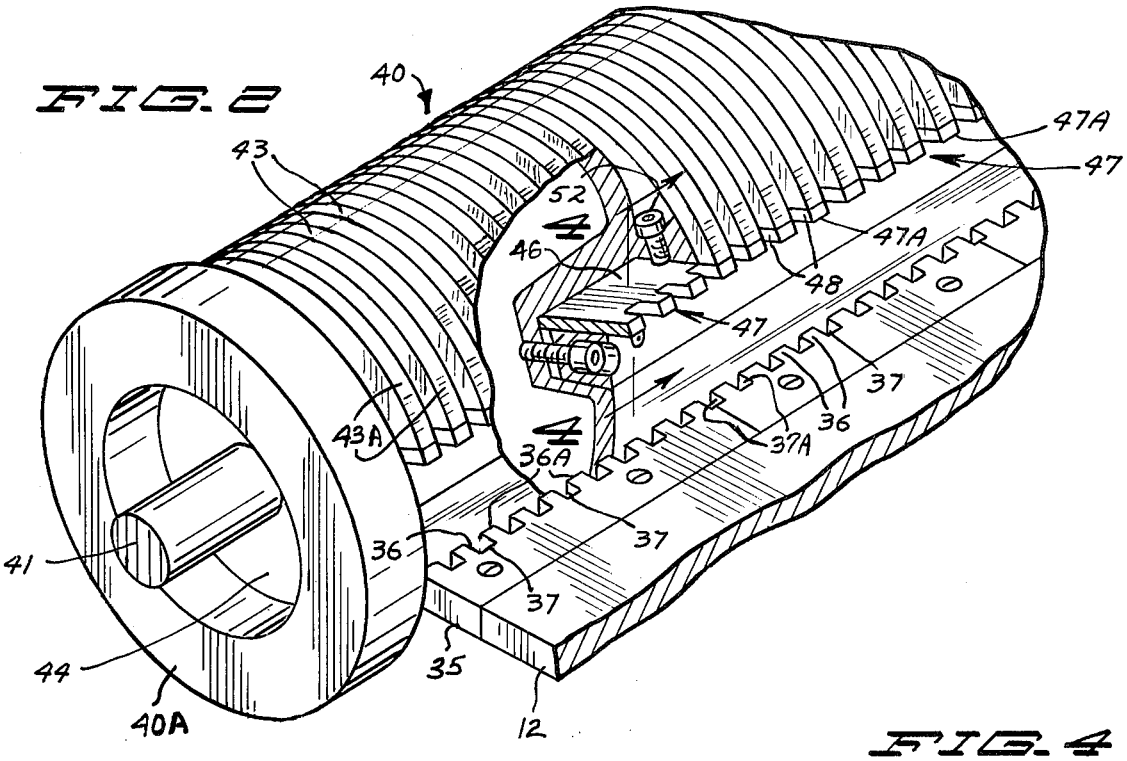

A cutting device illustrated generally at 10 as shown includes a main frame 11, that includes an infeed table 12 and suitable supports 13. The frame 11 may include means for rotatably mounting a pair of rollers 14 and 15, that have upper surfaces that protrude through openings 16 in the table 12, so that the periphery of each roller is slightly above the top plane of the table. Suitable side supports or walls 17 can be provided on the unit for mounting upper compression feed rollers.

As shown, a first compression roller 20 is suitably mounted in a sliding block bearing 21, which is shown only schematically and in dotted lines. The sliding block bearing 21 in turn is slidably mounted along the edges of a slot 22 that extends in vertical direction in wall 17, and a spring 23 may be mounted in any suitable manner to bear against the sliding block bearing 21 to resiliently urge the roller 20 in direction toward the upper surface of the table 12. As can be seen, the first roller 20 is raised above the level of the table 12 a certain distance that is selected to initially compress the material being fed in slightly and feed it toward the rotor. A tire 25 is shown being fed, and the machine is designed to be used with such tires to reduce the tires into uniform size pieces of material.

A second upper compression feed roller 26 is also mounted on the wall 17 with a sliding block bearing 27 mounted in a slot 28, and loaded with a spring shown schematically at 29 in a downwardly direction toward the upper surface of the table 12. These two spring loaded rollers of course can yield, and the springs are selected to have sufficient force to exert a pressure on the tire 25 being fed in.

A final compression roller 32 is mounted in a slot 33 in the wall 17, and is spring loaded with a spring 33A. The roll 32 compresses the material a substantial amount before it is fed into the rotor that will chop the material or reduce the material to uniform size pieces.

The bed 12 terminates along an edge with a stationary toothed blade 35 mounted with suitable cap screws 35A to the bed. The blade mounts flush with the top of the table, and the blade can be made into sections for ease of manufacture and removal, as shown perhaps best in FIG. 2. The blade comprises a plurality of alternating teeth and notches, and each of generally rectangular shape. The teeth 36 have outer ends 36A, and each of the notches between the teeth have inner edges or ends 37 and parallel side surfaces positioned at right angles to the outer end edges and at right angles to the axis to rotation of the rotor. These side surfaces are shown at 37A (FIG. 2).

A rotor 40 is mounted on a central shaft 41 that has a rotational axis generally parallel to the edges 36A of the teeth 36 on the blade 35. As shown, the rotor has an outer wall 42, which forms a hollow interior and is supported with suitable radial webs 44 drivably mounted on the shaft 41. The outer wall 42 is provided with a plurality of part annular grooves 43 forming ribs 43A between the grooves, and at two positions spaced 180° apart, the rotor wall is formed to provide a mounting ledge or shoulder indicated generally at 45 for mounting a rotor blade 46. The blade 46 may be made in sections, each extending for a portion of the axial length of the rotor, if desired. The rotor blade 46 is provided with a plurality of rectangular teeth 47, which have outer end edges 47A generally parallel to the axis of rotation and side surfaces substantially at right angles to the end edges 47A, and to the axis of the rotor, which side surfaces form grooves 48 between the teeth. The grooves 43 align with the grooves 48 between the teeth 47 so that the teeth 47 are backed by the ribs 43A. The teeth 47 are of size to fit between the teeth 36, that is in the slots 37, and the teeth 36 fit in the grooves 48, and also will fit in the grooves 43 defined in the outer surface of the rotor. Each rib 43A provides a backing member for one of the teeth 47, to securely support the rotationally trailing side of the teeth during use. The teeth 47 and 36 interdigitate as the rotor is driven. There is very little clearance provided between the side surfaces of the teeth 47 and the teeth 36. The teeth fit as closely as possible, for example with only a few thousands of an inch clearance to provide a scissor like action. The rotor has flywheels 40A at opposite ends thereof, which are slightly larger in diameter than the main portion of the rotor as shown.

Figure 3:
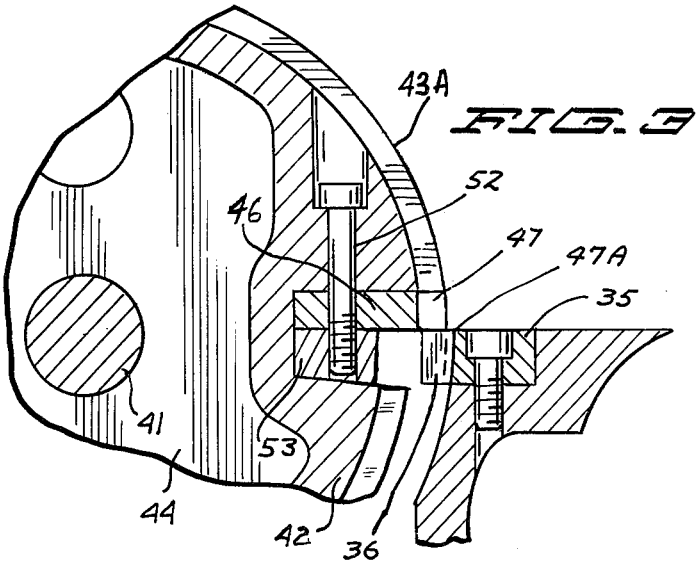
FIG. 3 is a fragmentary vertical sectional view of a portion of the rotor showing the teeth carried thereby about to mesh with the teeth carried on the bed knife.

As shown in FIG. 3, cap screws 52 can be used for holding the blade or knife 46 in position in combination with a wedge member 53 that is tightened against the leading side of blade 46 with cap screws 52 to wedge the rotating blade or knife 46 securely against its mounting surface as shown in FIGS. 1 and 3, to securely hold the rotating blade in place on the rotor. The clearance (non-threaded) openings for the cap screws 52 in the rotor, and cap screws 54 in the wedge permit using both sets of cap screws to secure and lock the wedge in place.

It will be noted that the grooves 43 are the same depth throughout the length thereof. The bottoms of the grooves are illustrated in FIG. 1 in dotted lines at 43B. The bottoms of grooves 43 and outer surfaces of ribs 43A are not concentric with the axis of rotation, but are concentric with each other. As the material, such as a tire carcass, is fed into the rotor after an initial cut, the edges of the ribs 43A, and the bottom 43B of the grooves 43 tend to move away from the mating edges of the teeth on bar 35 as the rotor rotates in the direction indicated by arrow 58. The tire carcass can thus be fed toward the center of the rotor and the next cut will be made by the teeth that are 180° from the teeth making the initial cut. The amount of material that can be fed, that is the linear distance that the material can be moved into the rotor between each cut is limited by the amount the center of the outer surface of ribs 43A and the center of the bottom surface 43B of grooves 43 is offset from the axis of shaft 41, or by the radial depth of grooves 43, if the depth is less than the amount of offset.

Figure 4:
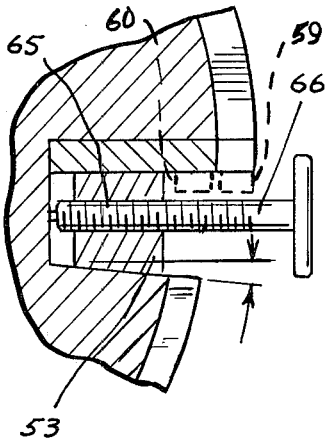
FIG. 4 is a fragmentary sectional view taken as on line 4—4 in FIG. 2 showing means for removing a wedge that holds the teeth on the rotor in place.
Figure 5:
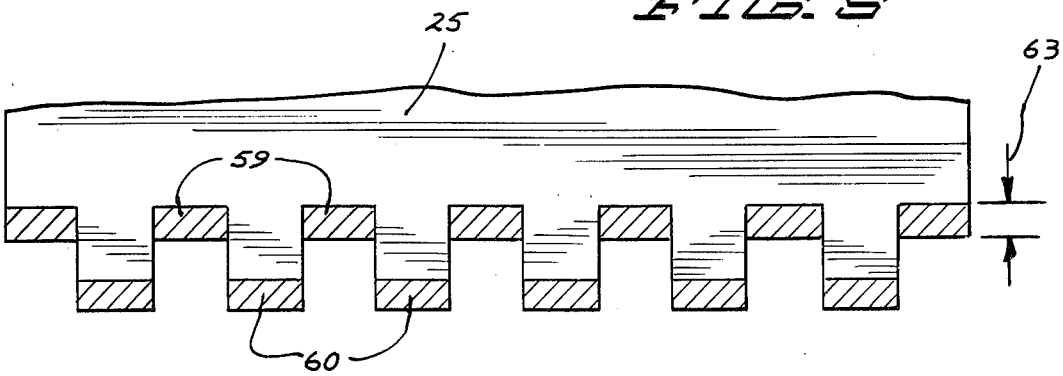
FIG. 5 is a schematic representation of a piece of material being chopped by the device of the present invention and illustrating the type of cut that will be made by the teeth of the rotor and the bed knife when the material is not being fed to the full depth of the teeth.

Referring to FIG. 5, the pieces that are severed from a piece of tire carcass 25 are shown shaded at 59 and 60 with the pieces 59 having been severed by the outer ends 47A of the teeth 47 mating with the inner edges 37 between the teeth 36, and the pieces 60 shown as having been severed by the outer edges 36A fitting between the teeth 47 and mating with the inner edges of the recess between the teeth 47. For sake of explanation and only for illustrative purposes, two pieces 59 and 60 are also represented in FIG. 4 in dotted lines in the position where they would be severed during a typical pass, but without full depth feed.

The projection of the tire carcass from which pieces 60 are cut will fit between the ribs 43A in the grooves 43, and thus the tendency of side shift is substantially reduced over other types of cutters.

When the rotor assembly 40 is powered, by a motor shown schematically at 56, through a drive link illustrated by a dotted line 57 such as a chain and sprocket, or gear drive, the rotor will rotate as indicated by the arrow 58. The side edges and ends of the teeth 47 mate closely with the side edges and ends of the teeth 36. Any material resting on the teeth 36 will be cut off by the teeth 47. The tire carcass 25 shown in FIG. 5 is advanced and the next pass of the other cutting blade 46 will remove the segment 59 from the base of each of the notches cut in the material during the first pass, and pieces 60 at the outer ends of the projections will also be cut off as previously explained. If a motor 61 is used to drive the feed rolls through suitable drive links represented by dotted lines 62 in synchronization with the speed of the motor 56, small chunks such as those shown at 59 and 60 will be severed from the tire carcass 25. These individual pieces or chunks 59 and 60 form discrete pieces that can be fed easily and automatically and can be used as a low cost fuel. The double arrows indicated generally at 63 show the amount of feed between passes of the respective knives 46 in order to get the shape of the pieces shown in the shaded lines. If a greater rate of feed is used, the pieces would be longer in the feeding direction and if less feed is used the pieces would be smaller in length indicated by the double arrows 63.

The rolls 20 and 26, which are spring loaded will compress the tire carcass 25, which has been debeaded as shown, and the roll 32 will make the final compression. The rolls 14 and 15 also will power drive the material at a known rate synchronized by the motor 61 and drive links 62, such as chains and sprockets, so that the infeed will be substantially uniform. Uniform pieces will then be cut out.

Any tendency of the tire carcass 25 to shift sideways (in axial direction of the rotor) from its position will be resisted by the side edges or grooves 43 defined in the rotor, as the rotor rotates and as the tire carcass is fed into the rotor, so that there will not be any substantial tendency to make irregular pieces. If side shift does occur, the pieces would still not be strips, but will have a generally L shape or Z shape. However, they will still be discrete pieces and not a continuous strip across the width of the tire carcass. The base surfaces of the grooves 43 and outer surfaces of ribs 43A will provide a bearing surface against which the tire carcass will be stopped to prevent excessive infeed of the carcass.

Referring to FIG. 4, a means for removing the wedge 53 from the wedge groove when the knives are to be replaced is shown. The wedges are provided with threaded openings 65, at a desired number of positions spaced in direction along the longitudinal axis of a shaft 41 from the cap screws 54. A hand screw with a T handle illustrated generally at 66 can be threaded into these provided openings 65, and the end of the screw will bear against the inner surface of the wedge groove, so that as the T handle 66 is threaded the wedge 53 will be pulled out of its groove, to permit easy replacing of the knives.

A swinging cover 68 is pivotally mounted as at 69 to the frame 11, and as shown goes over the rolls 20 and 26, to provide a shield and protection. A hydraulic cylinder may be used for controlling this cover, so that it can be raised up substantially perpendicular and sharpeners can be clamped right on to the rotor for sharpening the blades 46 while they are still on the rotor. The blades would be ground along their leading surface for sharpening. Likewise, the sharpeners can be mounted on the bed 12 for sharpening the bed knife 35 by grinding the upper surface on both the movable and stationary blades. The teeth may be formed with silicon carbide inserts on the wear surfaces.

A liquid, such as water, may be sprayed onto the tire in the cutting area as a coolant and lubricant. Any desired spray pattern can be used. For example, a water tube 70 can be attached directly to the cover 68 and may be provided with nozzles to spray down into the cutting area.

Further, a flexible hose and suitable valve control can be used so that the cover can be lifted without disconnecting the water.

What is claimed is:

1. A device for chopping elastomeric materials comprising a support frame, a rotor including at least one movable cutting blade extending in direction axially along the rotor, said movable cutting blade having a plurality of teeth formed adjacent one edge thereof extending toward the periphery of the rotor, said teeth being defined by outer end edges and spaced side edges generally perpendicular to the axis of rotation of said rotor, a stationary cutting blade having a cutting edge having teeth adapted to mate with and be complimentary to the teeth formed on said movable cutting blade including side stationary teeth edges parallel to the side edges of the teeth on the rotor, and means to mount said stationary cutting blade adjacent the peripheral edge of said rotor so that said movable cutting blade teeth and said stationary cutting blade teeth interfit upon rotation of said rotor and the adjacent side edges of interfitting teeth provide a scissor like cutting action along the mating sides of the movable and stationary teeth.

2. The combination as specified in claim 1 and means to advance an elastomeric material, such as a pneumatic tire across said stationary cutting blade.

3. The combination as specified in claim 2 and means to provide a lubricant on elastomeric materials adjacent the stationary cutting blade.

4. The combination as specified in claim 1 wherein said rotor has a pair of cutting blades mounted thereon, and said rotor having a peripheral wall which is formed so that the rotationally leading surface of said movable cutting blade is exposed radially inwardly from the radially outer end of each of said teeth on said movable blade a selected amount.

5. The combination as specified in claim 1 wherein the outer ends of said teeth on said movable cutting blade and the outer ends of said teeth on said stationary cutting blade pass closely adjacent inner ends of the spaces between the teeth on the respective opposite blade.

6. The combination as specified in claim 1 wherein said stationary cutting blade has a generally planar surface for supporting elastomeric materials, and said surface defines a plane that passes substantially through the axis of rotation of said rotor.

7. A device for shredding polymers such as vehicle tires comprising a support frame, movable cutting blade means having a rotationally leading surface and a cutting edge formed into a plurality of speced, blunt ended parallel sided teeth rotatably mounted on said frame about an axis, stationary cutting blade means having a generally planar feed surface and a cutting edge formed into a plurality of spaced blunt ended parallel sided teeth, the teeth formed on said movable cutting blade means and on said stationary cutting blade means interdigitating upon rotation of said movable cutting blade means to provide discrete pieces of polymeric material advanced across the stationary cutting blade means, the plane of said feed surface being substantially parallel to and intersecting said axis of rotation, said movable cutting blade means being positioned so that the leading surface thereof is parallel to the feed surface substantially at the time when the respective teeth on the movable blade means reach the plane of the feed surface on a cutting stroke.

8. A device for chopping elastomeric materials comprising a support frame, a rotor rotatably mounted on said frame comprising a wall member having a plurality of part annular grooves formed therein, and ribs formed between said part annular grooves, at least one movable cutting blade extending in direction axially along the rotor, said movable cutting blade having a plurality of teeth formed adjacent one edge thereof extending toward the periphery of the rotor, said ribs being positioned to back said teeth of said movable cutting blade on a rotationally trailing side of said movable cutting blade, said teeth on said movable cutting blade being defined by outer end edges and spaced side edges generally perpendicular to the axis of rotation of said rotor, a stationary cutting blade mounted on said frame having teeth adapted to mate with and be complimentary to the teeth formed on said movable cutting blade, and means to mount said stationary cutting blade adjacent the peripheral edge of said rotor so that said movable cutting blade teeth and said stationary cutting blade teeth interfit upon rotation of said rotor, and the teeth on said stationary cutting blade align with and pass through portions of said grooves on said rotor as said rotor rotates.

9. The combination as specified in claim 8 and power means to advance material into said movable cutting blade.

10. The combination of claim 8 wherein said ribs have part annular outer surfaces and said grooves have part annular bottom surfaces, said part annular outer and bottom surfaces being concentric with each other and being centered on an axis offset from the axis of rotation of said rotor.

11. The combination of claim 10 wherein the outer end edges of said movable teeth do not extend substantially beyond the part annular outer surfaces of aligning ribs in radial direction.

12. The combination of claim 11 wherein said teeth on said stationary cutting blade have end edges generally parallel to the bottom surfaces of said grooves and closely spaced from said bottom surfaces when the cutting blades first start to interfit during rotation of said rotor.

13. The combination of claim 11 wherein there are a plurality of movable cutting blades evenly spaced around the rotor, each of said movable cutting blades being backed by separate sets of part annular ribs extending around the periphery of the rotor from the movable cutting blade associated therewith to adjoin the next rotationally trailing cutting blade, the respective center of the outer surfaces of the separate sets of part annular ribs being offset from the axis of the rotation of the rotor in a different radial direction.

14. A device for chopping elastomeric materials comprising a support frame, a rotor including at least one movable cutting blade extending in direction axially along said rotor and being rotatably mounted on said frame, said movable cutting blade having a plurality of teeth formed adjacent one edge thereof extending toward the periphery of the rotor, said teeth being defined by outer end edges and spaced side edges generally perpendicular to the axis of rotation of said rotor, means to retain said movable cutting blade on said rotor including a wedge groove defined in said rotor and extending along and opening to said movable blade, said movable blade being backed by a shoulder formed on said rotor, a wedge mounted in said wedge groove and forced against said movable blade to force the blade against said shoulder, means to retain said wedge in position in said groove, a stationary cutting blade having a cutting edge having teeth adapted to mate with and be complimentary to the teeth formed in said movable cutting blade, and means to mount said stationary cutting blade adjacent the peripheral edge of said rotor so that said movable cutting blade teeth and said stationary cutting blade teeth interfit upon rotation of said rotor.

15. The device of claim 14 wherein said wedge groove has a bottom surface, a threaded opening in at least one portion of said wedge and a removable tool threadable into said threadable opening and against said bottom surface to force said wedge outwardly from the bottom surface.

* * * * *

UNITED STATES PATENT AND TRADEMARK OFFICE

CERTIFICATE OF CORRECTION

PATENT NO. : 4,015,782

DATED : April 5, 1977

INVENTOR(S) : Bernard H. Granite

It is certified that error appears in the above-identified patent and that said Letters Patent are hereby corrected as shown below:

Column 6, line 36, (Claim 7, line 4), "speced" should be --spaced--. Column 7, line 28, (Claim 13, line 1), "Claim 11" should be--Claim 10--.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*